US011089912B2

(12) United States Patent
Talada et al.

(10) Patent No.: US 11,089,912 B2
(45) Date of Patent: Aug. 17, 2021

(54) STACKABLE TOILET

(71) Applicant: AGOG HOLDINGS PTE LIMITED, Singapore (SG)

(72) Inventors: Ramesh Talada, Hyderabad (IN); Asif Mohd., Hyderabad (IN); Soham Bhowmick, Hyderabad (IN)

(73) Assignee: AGOG HOLDINGS PTE LIMITED, Singapore (SG)

( * ) Notice: Subject to any disclaimer, the term of this patent is extended or adjusted under 35 U.S.C. 154(b) by 0 days.

(21) Appl. No.: 16/624,901

(22) PCT Filed: Jun. 22, 2018

(86) PCT No.: PCT/IB2018/054613
§ 371 (c)(1),
(2) Date: Dec. 19, 2019

(87) PCT Pub. No.: WO2018/235041
PCT Pub. Date: Dec. 27, 2018

(65) Prior Publication Data

US 2020/0129011 A1 Apr. 30, 2020

(30) Foreign Application Priority Data

Jun. 22, 2017 (IN) ..... 201741021963

(51) Int. Cl.
*A47K 4/00* (2006.01)
*A47K 3/32* (2006.01)
(Continued)

(52) U.S. Cl.
CPC ..... *A47K 4/00* (2013.01); *A47K 3/32* (2013.01); *E03C 1/01* (2013.01); *E03D 11/12* (2013.01)

(58) Field of Classification Search
CPC ..... A47K 4/00
(Continued)

(56) References Cited

U.S. PATENT DOCUMENTS 1,580,661 A * 4/1926 Funk ..... A47K 4/00 52/32
2,557,470 A * 6/1951 Rollie ..... E03C 1/01 4/663
(Continued)

FOREIGN PATENT DOCUMENTS

CN 202482970 U 10/2012
CN 205306834 U 6/2016
(Continued)

*Primary Examiner* — Christine J Skubinna
(74) *Attorney, Agent, or Firm* — Winston Hsu

(57) ABSTRACT

The present subject matter relates to a stackable toilet cabinet comprising a shower unit 101 arranged in the upper portion of said cabinet; a commode unit 102 arranged in a lower portion of said cabinet; and a wash basin 103 arranged in the upper portion of said cabinet alongside the shower unit 101. The shower unit 101 comprising a concealed shower head in a top housing of said cabinet; and a hand shower and a mixer to actuate the shower unit 101. The commode unit 102 further comprising a pull doors 126*a*, 126*b*; a commode 144 connected with a back plate 128 arranged on a wheel base 124, the commode 144 being connected with a soil pipe 130 and two or more telescopic rails 129 for enabling the forward movement of the commode unit 102; and a handle 125 to pull the commode 144.

15 Claims, 11 Drawing Sheets

(51) Int. Cl.
*E03C 1/01* (2006.01)
*E03D 11/12* (2006.01)

(58) Field of Classification Search
USPC ..... 4/663
See application file for complete search history.

(56) References Cited

U.S. PATENT DOCUMENTS

| | | | | | |
|---|---|---|---|---|---|
| 4,117,555 | A * | 10/1978 | Dennis | A01K 1/011 | 119/163 |
| 4,680,817 | A * | 7/1987 | Sloan | E03C 1/01 | 4/312 |
| 5,742,956 | A * | 4/1998 | Tarver | A47K 4/00 | 4/644 |
| 9,909,286 | B2 * | 3/2018 | Meressa | A47K 4/00 | |
| 2014/0245531 | A1 * | 9/2014 | Carver | E03D 11/12 | 4/312 |

FOREIGN PATENT DOCUMENTS

| | | | |
|---|---|---|---|
| DE | 20307118 | U1 | 7/2004 |
| GB | 2449107 | B | 6/2011 |
| KR | 19990040515 | U | 12/1999 |

* cited by examiner

STACKABLE TOILET

TECHNICAL FIELD

The present subject matter, described herein, in general, relates to the sanitary unit and in particular, relates to a moveable bathroom fixture, for example, a stackable toilet.

BACKGROUND

Conventional bathrooms are designed so that the typical bathroom fixtures (sinks, walls, showers, toilets, etc.) are permanently secured in place when construction is completed. This means that the placement of these fixtures may be suitable for the first user, but may not be acceptable to subsequent users. Subsequent users may find the design unacceptable for many reasons, including their age, height, physical mobility (or disability), etc. The prior art has, as of yet, failed to appreciate this problem, much less suggest a solution.

Every bathroom or sanitary unit has three key components, namely, a sink or a wash basin, a commode, and a shower. These components are at different heights, with the commode being at a lower level, the sink approximately at waist height and the shower head approximately over the head of the user. However, all these components are usually arranged horizontally and not vertically. Also, a person uses only one of the components at an instant of time, while the space occupied by the other two components is technically wasted.

U.S. Pat. No. 5,337,525 (Zaccai et al.) discusses flexibility, but only to a narrow extent. This patent discloses a rail system in the bathing area. The rail system allows soap dishes and seats to be positioned around the bathing area, but the size of the bathing area is fixed, and the placement of the showerhead/faucet is fixed as well.

All other prior art patents either use modularity to make construction easier, or modify bathroom fixtures for use by handicapped individuals. In every case, the fixtures are permanently built into the bathroom structure, preventing flexibility.

The following patents all teach modularity: U.S. Pat. No. 3,230,549 (McMurtrie et al.); U.S. Pat. No. 3,533,200 (Zoebelein); U.S. Pat. No. 3,765,139 (Litvin et al.); U.S. Pat. No. 4,653,128 (Canalizo); and U.S. Pat. No. 5,903,937 (Clarke). The context of the modularity in every case is to lower the cost of fabrication, storage, and delivery of the bathroom unit. The object of all these patented inventions is to provide a conventional bathroom at a lower cost. In every case, the bathroom constructed has all the fixtures permanently attached to the walls and/or floor.

U.S. Pat. No. 4,928,329 (Palmeri) discloses modified conventional bathroom fixtures for use by the handicapped. This invention simply replaces permanent conventional fixtures with the permanent handicapped accessible fixtures.

Hence, there exists a need for a bathroom or an integrated sanitary unit which may be designed with all the essential components, such as a sink, a commode, and a shower, and simultaneously addresses the problems of space constraint in any given space, without compromising on the functionality.

SUMMARY

It is an object of the present subject matter to provide a moveable bathroom fixture that may be fitted in any space without compromising on luxury.

It is another object of the present subject matter to provide an integrated moveable bathroom fixture with all the essential components, for example, a shower unit, commode unit, and a sink.

It is another object of the present subject matter to provide an integrated moveable bathroom fixture that has essential stacked utilities of a toilet that enables it to function on the lines of a plug-and-play device.

It is yet another object of the present subject matter to provide an integrated moveable bathroom fixture that is space saving.

It is yet another object of the present subject matter to provide a moveable bathroom fixture that is cost effective.

It is yet another object of the present subject matter to provide a moveable bathroom fixture that is easy to move as per the user convenience.

It is yet another object of the present subject matter to provide a moveable bathroom fixture that enhances the aesthetic appeal of the integrated system by including a concealed system of pipes and cisterns.

The present subject matter, described herein, relates to a moveable bathroom fixture and, more particularly, to a stackable toilet. The stackable toilet comprising a housing cabinet that comprises a shower unit, a commode unit, and a wash basin. The shower unit is arranged in the upper portion of said cabinet. The commode unit arranged in a lower portion of the housing cabinet. The wash basin arranged in the upper portion of the housing cabinet alongside the shower unit.

In accordance with an embodiment of the present subject matter, the shower unit may comprise a concealed shower head in a top housing of the housing cabinet; and a hand shower and a mixer to actuate the shower unit.

In accordance with another embodiment of the present subject matter, the shower unit may be arranged on a wheel base to drag it from a rest position to a useable position.

In accordance with another embodiment of the present subject matter, the commode unit may comprise a pull doors; a commode connected with a back plate arranged on a wheel base, the commode being connected with a soil pipe and two or more telescopic rails for enabling the forward movement of the commode unit; and a handle to pull the commode.

In accordance with another embodiment of the present subject matter, the commode of the commode unit may be connected with a flush tank by a flush water pipe.

In accordance with another embodiment of the present subject matter, the wash basin may be arranged underneath a mirror in the upper portion of the housing cabinet at a waist height.

In accordance with another embodiment of the present subject matter, the wash basin may comprise one or more stands for toothbrush and one or more trays for soaps.

In accordance with another embodiment of the present subject matter, a storage cabinet may be arranged underneath the shower unit in the upper portion of the housing cabinet.

In accordance with another embodiment of the present subject matter, a storage cabinet may be arranged in the lower portion of the housing cabinet.

In accordance with another embodiment of the present subject matter, the stackable toilet may comprises a concealed system of pipes and cisterns to connect the shower unit, the commode unit, the wash basin, the flush tank and the like.

In accordance with another embodiment of the present subject matter, a power socket may be arranged in between the mirror and the wash basin in the upper portion of the housing cabinet.

In accordance with another embodiment of the present subject matter, the wash basin or the sink, arranged on a wall and vertical poles, may be moveable along a vertical direction. The wash basin sink may be arranged on a spring bar for its vertical movement.

In accordance with another embodiment of the present subject matter, the wash basin may be moveable and locked at different heights by locking the spring bar at different locking holes. The locking holes may be arranged on the vertical poles.

The present subject matter, described herein, relates to the stackable toilet that provides an integrated system of shower unit, commode unit, and wash basin that saves space, saves cost and provides a compact structure. The component of the stackable toilet are arranged on a wheel base for to and fro movement as and when they are required to be used. The stackable toilet also comprises a concealed system of pipes and cisterns to enhance the aesthetic appeal of the cabinet.

BRIEF DESCRIPTION OF ACCOMPANYING DRAWINGS

The foregoing and further objects, features and advantages of the present subject matter will become apparent from the following description of exemplary embodiments with reference to the accompanying drawings, wherein like numerals are used to represent like elements.

It is to be noted, however, that the appended drawings illustrate only typical embodiments of the present subject matter, and are therefore, not to be considered for limiting of its scope, for the subject matter may admit to other equally effective embodiments.

DETAILED DESCRIPTION

Figure 1A:
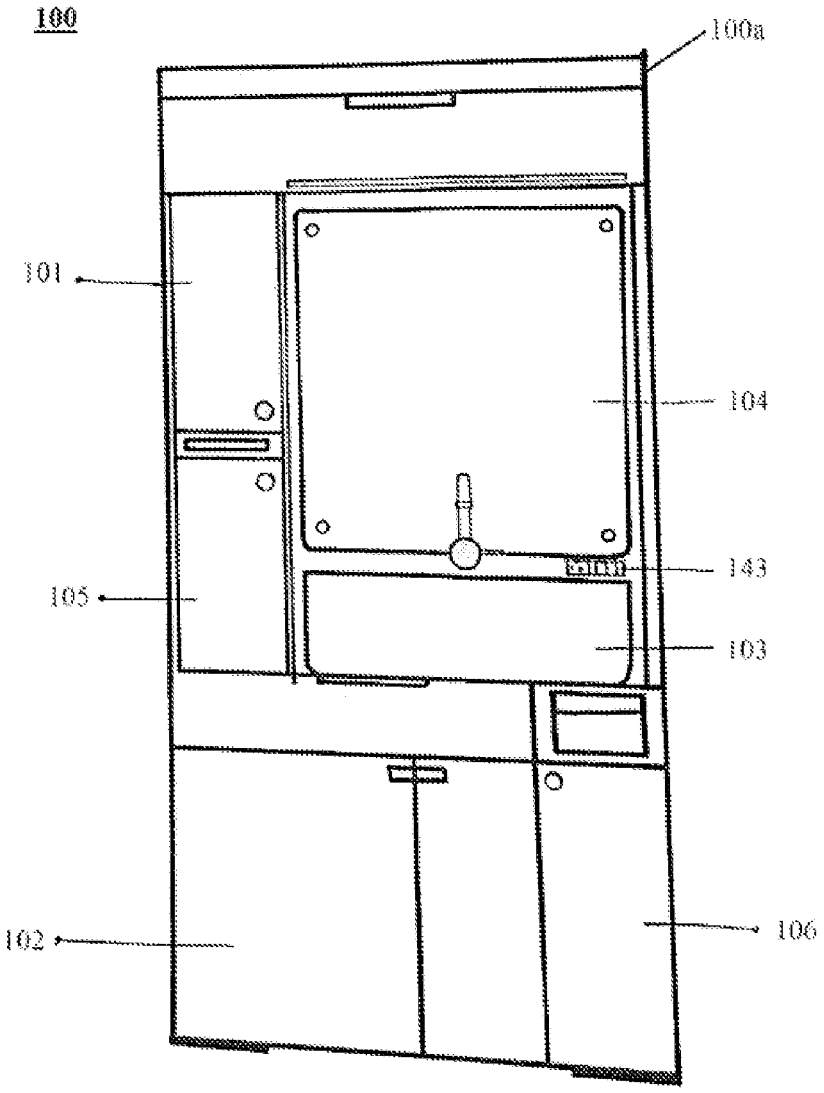
FIG. 1A illustrates a stackable toilet in accordance with an embodiment of the present subject matter.

The following presents a detailed description of various embodiments of the present subject matter with reference to the accompanying drawings.

The embodiments of the present subject matter are described in detail with reference to the accompanying drawings. However, the present subject matter is not limited to these embodiments which are only provided to explain more clearly the present subject matter to a person skilled in the art of the present disclosure. In the accompanying drawings, like reference numerals are used to indicate like components.

The specification may refer to "an", "one", "different" or "some" embodiment(s) in several locations. This does not necessarily imply that each such reference is to the same embodiment(s), or that the feature only applies to a single embodiment. Single features of different embodiments may also be combined to provide other embodiments.

As used herein, the singular forms "a", "an" and "the" are intended to include the plural forms as well, unless expressly stated otherwise. It will be further understood that the terms "includes", "comprises", "including" and/or "comprising" when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "attached" or "connected" or "coupled" or "mounted" to another element, it can be directly attached or connected or coupled to the other element or intervening elements may be present. As used herein, the term "and/or" includes any and all combinations and arrangements of one or more of the associated listed items.

The figures depict a simplified structure only showing some elements and functional entities, all being logical units whose implementation may differ from what is shown.

FIG. 1A illustrates a stackable toilet 100 in accordance with an embodiment of the present subject matter. The stackable toilet 100, as described herein, comprises multiple bathroom fixtures stacked in a single cabinet 100*a*. The stackable toilet 100 of the present subject matter is a vertical cabinet or a housing cabinet 100*a* comprising a shower unit 101, a commode unit 102, and a wash basin or a sink 103 with a mirror 104. The wash basin 103 is arranged underneath the mirror 104 on an upper portion of the stackable toilet. The shower unit 101, the wash basin 103, and the mirror 104 are arranged on the upper portion of the housing cabinet 100*a* while the commode unit 102 is arranged on a lower portion of the housing cabinet 100*a*.

In an embodiment of the present subject matter, two or more storage cabinets may be arranged on the upper portion and the lower portion of the housing cabinet of the stackable toilet. In an example, storage cabinet 105 is arranged underneath the shower unit on the upper portion of the housing cabinet 100*a* of the stackable toilet 100 and storage cabinet 106 is arranged on a side of the commode unit 102 on the lower portion of the housing cabinet 100*a* of the stackable toilet.

In another embodiment of the present subject matter, a power socket 143 may be arranged in between the mirror 104 and the wash basin 103.

In another embodiment of the present subject matter, the shower unit 101 and the commode unit 102 may rest on a wheel base and may be pulled away from a position of rest when required. The shower unit 101 may be pulled from a rest position to a useable position by using a handle 135. Similarly, the commode unit 102 may be pulled from a rest position to a useable position by using a handle 125.

The stackable toilet 100 having the housing cabinet 100*a* is an integrated system of the shower unit 101, the commode unit 102, and the wash basin 103 which is easily moveable inside a bathroom.

Figure 1B:
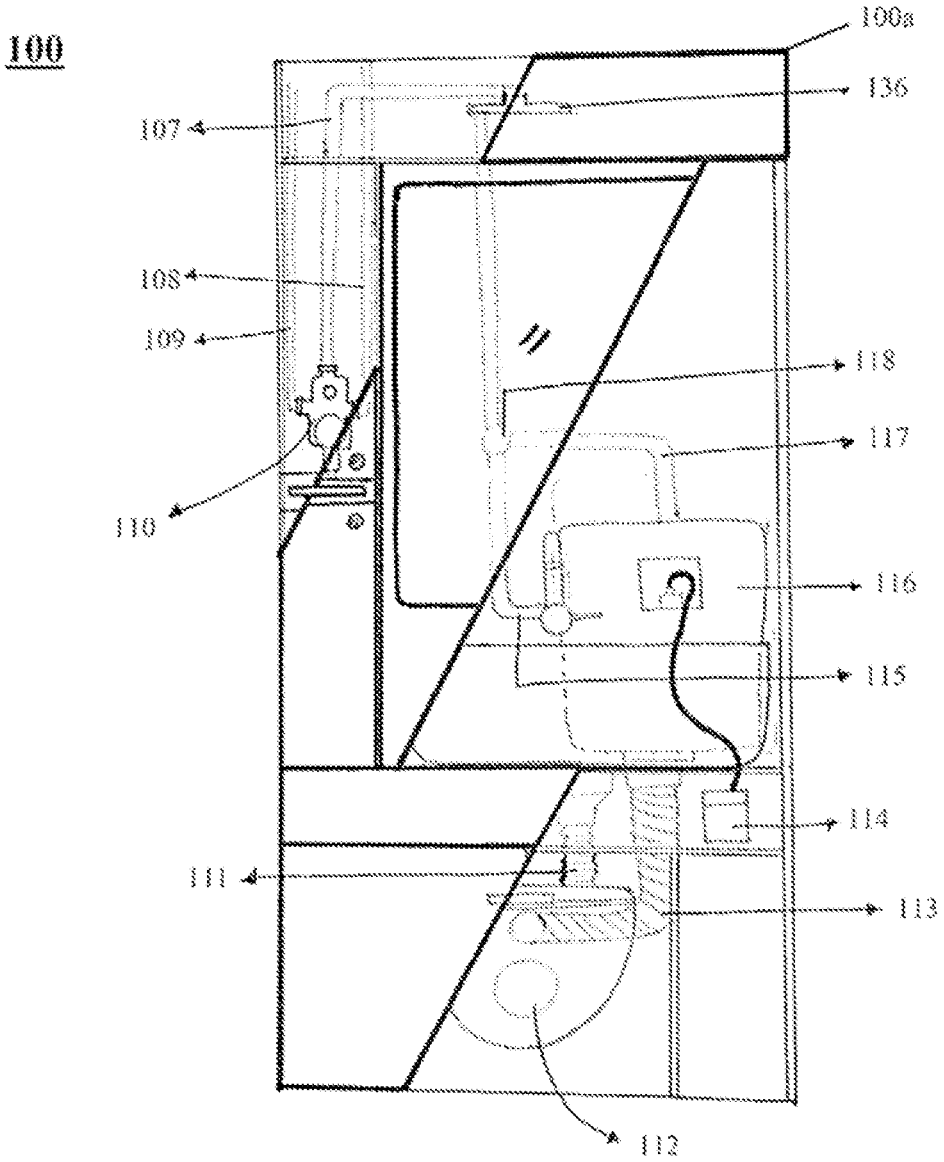
FIG. 1B illustrates a perspective view of a stackable toilet having a housing cabinet in accordance with another embodiment of the present subject matter.

FIG. 1B illustrates a sectional view of a stackable toilet 100 having a housing cabinet 100*a* in accordance with another embodiment of the present subject matter. The housing cabinet 100*a* of the stackable toilet 100 comprises a concealed system of pipes and cisterns connecting the shower unit, the commode unit and the wash basin with each other. The shower unit comprises a concealed shower head 136 in a top most section of the housing cabinet 100*a* of the stackable toilet 100 and a mixer 110 for mixing of hot water and cold water which may be supplied to the concealed shower head 136. The mixer 110 inputs hot water from hot water inlet 109 and cold water from cold water inlet 108 directly from a geyser. Further, the mixer 110 mixes the hot water and cold water and outputs the mixed water to the concealed shower head 136 by using a shower inlet 107.

In an embodiment of the present subject matter, main water inlet 118 supplies water to the flush tank 116 using flush tank inlet 117 and the wash basin using a tap water inlet 115. The flush tank may be actuated by a flush button 114 to dispose of the waste material from the commode unit. The commode unit may dispose the waste material; using a flush water outlet 113. Further, the commode of the commode unit may be connected with soil pipe 112 to drain out the waste material from the commode. Similarly, the wash basin may drain the water through a water outlet 111. Further, all the pipes and cisterns may be a concealed system and may not be visible to the user.

Figure 2:
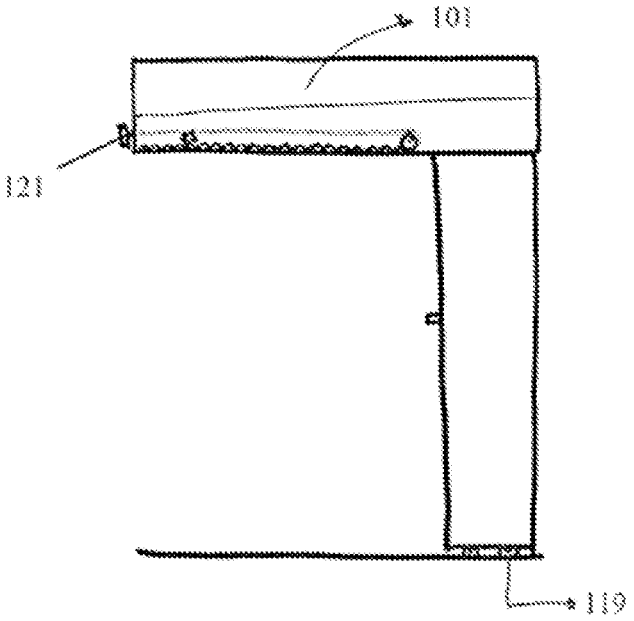
FIG. 2 illustrates a side sectional view of a shower unit of the housing cabinet of the stackable toilet in accordance with another embodiment of the present subject matter.
Figure 2:
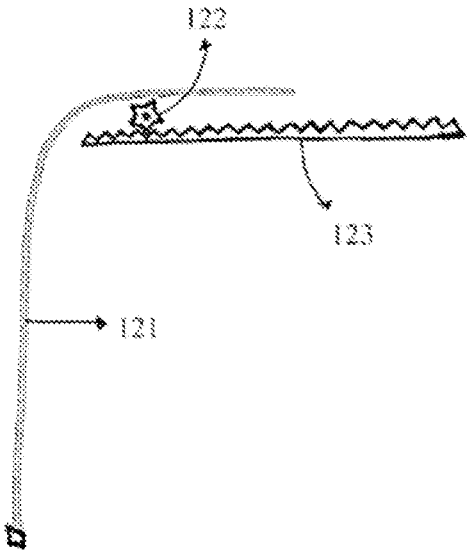

FIG. 2 illustrates a side sectional view of a shower unit 101 of the housing cabinet 100*a* of the stackable toilet in accordance with another embodiment of the present subject matter. The shower unit 101 may initially be at a rest position on a wheel base 119.

In accordance with an implementation of the present subject matter, the shower unit 101 may be pulled from a rest position to a useable position using the handle 135. When a user desires to use the shower unit 101, the user may drag the shower unit, present on the wheel base 119, to a useable position where the user may take bath. Further, the user may also drag a screen 121 that may be arranged on rack 123 and pinion 122 to avoid spilling of the water away from the housing cabinet of the stackable toilet.

In another embodiment of the present subject matter, the screen 121 may be motorized or may be manually actuated.

Figure 3A:
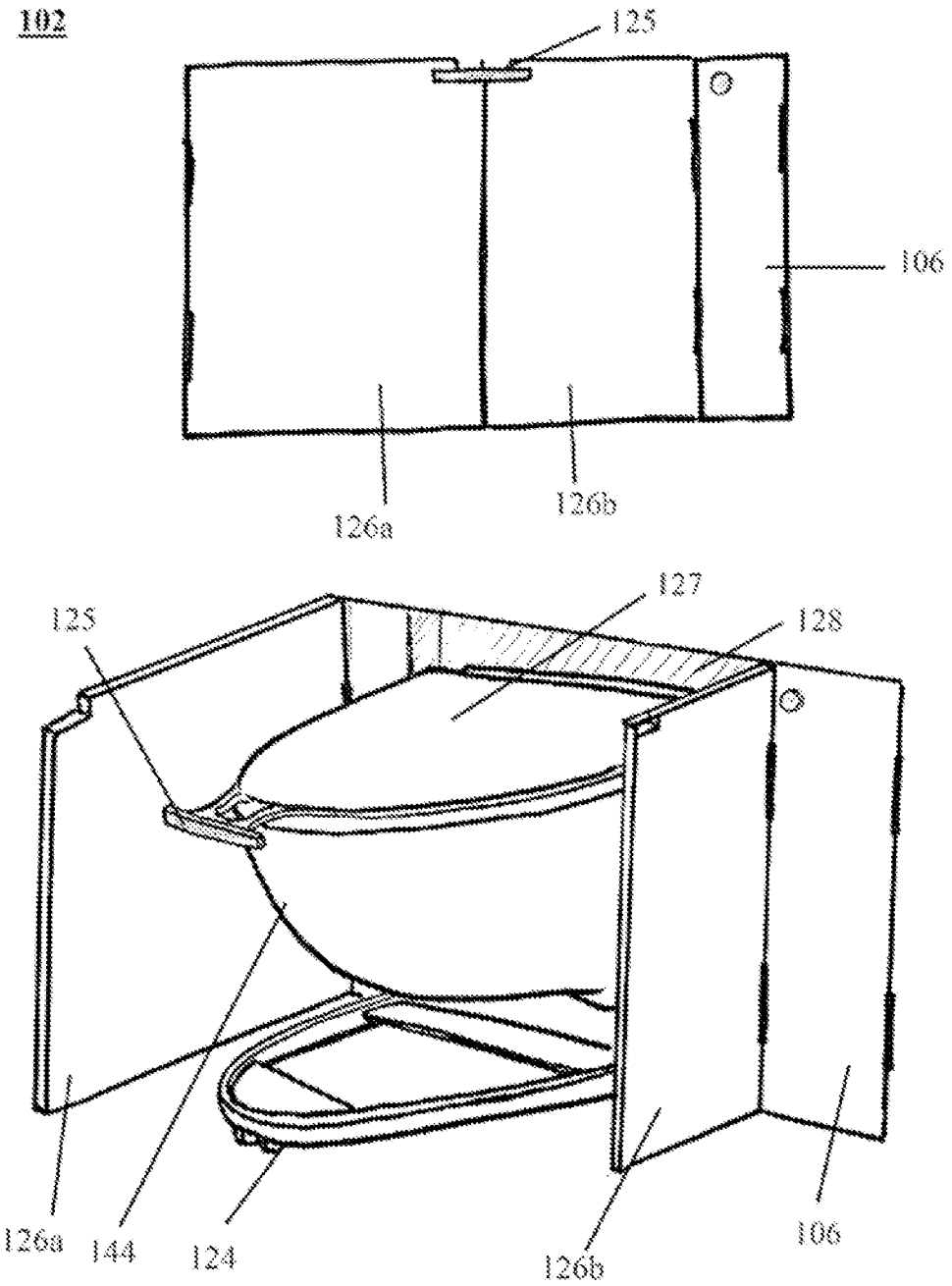
FIG. 3A illustrates an open and a closed position of a commode unit of the housing cabinet of the stackable toilet in accordance with an embodiment of the present subject matter.

FIG. 3A illustrates an open and a closed position of a commode unit of the housing cabinet of the stackable toilet in accordance with an embodiment of the present subject matter. The commode unit 102 comprises a commode 144 connected with a back plate 128 and a handle 125 connected with the toilet lid 127 of the commode 144. The back plate is further arranged on a wheel base 124. The commode 144 is concealed behind pull doors 126*a*, 126*b*. In a closed position, the commode 144 of the commode unit 102 may be concealed behind the pull doors 126*a*, 126*b* and only the handle 125 may be visible along with storage cabinet 106. The commode 144 may be connected with a back plate 128 on a wheel base 124 in its concealed position.

In accordance with an implementation of the present subject matter, the handle 125 may be used to drag the commode 144 from a rest position to a useable position and in doing so the pull doors 126*a* 126*b* may be wide opened. The wheel base 124 of the commode 144 may have stopper to keep the commode 144 in its useable position. Further, the toilet lid 127 of the commode 144 may be lifted to use the commode 144.

Figure 3B:
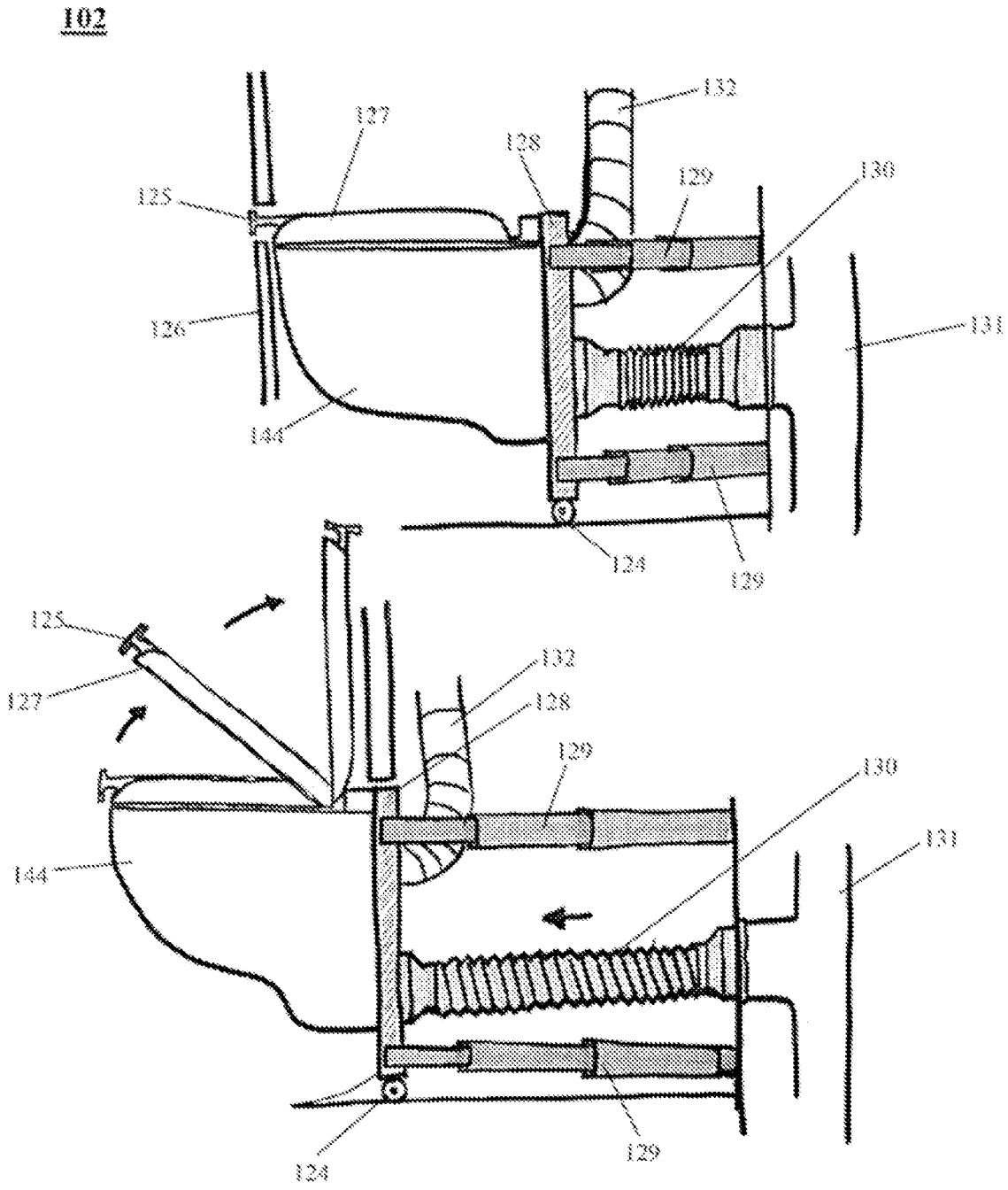
FIG. 3B illustrates a side sectional view of an open and a closed position of a commode unit of the housing cabinet of the stackable toilet in accordance with an embodiment of the present subject matter.

In another embodiment of the present subject matter, the commode 144 may rest on a back plate 128 that further rests on a wheel base 124 that may be used to drag the commode 144 outside the pull doors 126*a*, 126*b* as can be seen in FIG. 3B.

FIG. 3B illustrates a side sectional view of an open and a closed position of a commode unit of the housing cabinet of the stackable toilet in accordance with an embodiment of the present subject matter. In a closed position, the commode 144 is concealed behind the pull doors 126*a*, 126*b*. The commode 144 may be connected with a back plate 128 on a wheel base 124 in its concealed position. The back plate 128 is connected with two or more telescopic rails 129. The telescopic rails 129 may be retractable. The telescopic rails 129 extend from a position of rest when the commode 144 is dragged to its useable position.

In an embodiment of the present subject matter, the commode 144 is connected with a soil pipe 130 that is used to flush out the waste material from the commode 144. The soil pipe 130 is further connected with the main soil pipe 131 to drain out all the waste material from the commode 144.

In another embodiment of the present subject matter, the commode 144 may be connected with a flush (not shown in the figure) by a flush water pipe 132 to actuate the flushing in the commode 144.

In accordance with an implementation of the present subject matter, the handle 125 is used to drag out the commode 144 out from its rest position to a useable position. In doing so, the pull doors 126*a*, 126*b* are opened to enable to the use to see the commode unit. Subsequently, the user will lift the toilet lid 127 of the commode 144 and use it as per the user's convenience. The commode 144 is connected with a back plate 128 that rests on a wheel base 124 that is further used to drag the commode 144 in and out of the housing cabinet 100*a* of the stackable toilet 100. The telescopic rails 129 help in forward movement of the commode 144. The retractable soil pipe 130 further relaxes and contracts as per the use.

Figure 4A:
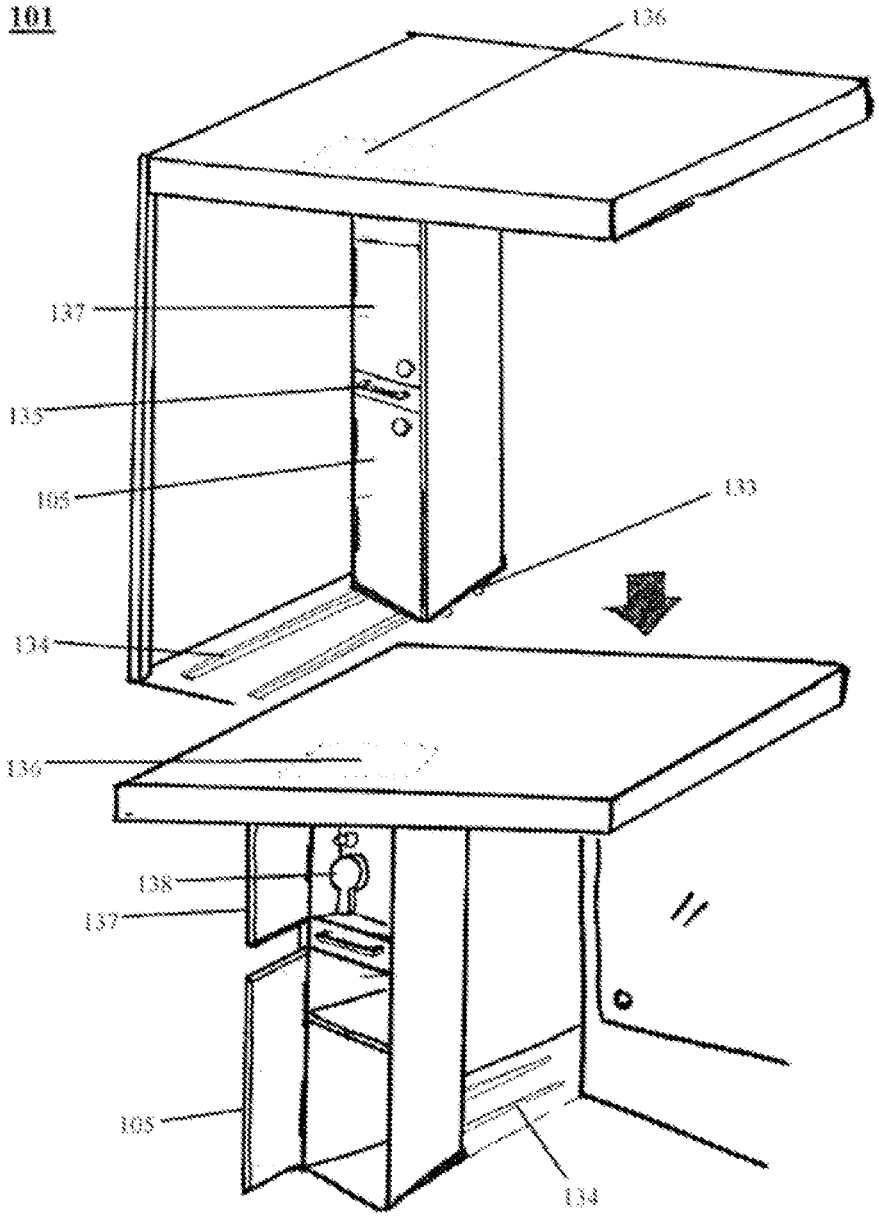
FIG. 4A illustrates a rest position and a useable position of a shower unit of the housing cabinet of the stackable toilet in accordance with an embodiment of the present subject matter.

FIG. 4A illustrates a rest position and a useable position of a shower unit of the housing cabinet of the stackable toilet in accordance with an embodiment of the present subject matter. In its rest position, the vertically erected shower unit 101 is arranged on a wheel base 133 for inwards and outwards movement. The shower unit 101 comprises a concealed shower head arranged in the topmost housing of the housing cabinet 100*a*, a door having a mixer 138, and storage cabinet 105 for storage various items related to sanitary purpose.

In an embodiment of the present subject matter, the shower unit 101 may be dragged from a rest position to a useable position using the wheel base 133 and rails 134 and in doing so, the concealed shower head arranged in the topmost housing of the housing cabinet 100*a* is also dragged along its way. Further, the door 137 may be opened in order to view the hand shower and mixer 138. The hand shower and the mixer 138 may be used to actuate the shower so that a user may take bath.

In another embodiment of the present subject matter, the shower unit may comprises a screen (as can be seen in FIG. 2) arranged in the topmost housing of the housing cabinet. The screen 121 may be dragged in a vertically downward direction so that while take bath the water does not spills away from the housing cabinet. Further, the screen 121, in an alternate embodiment, may be motorized or may be manually actuated.

Figure 4B:
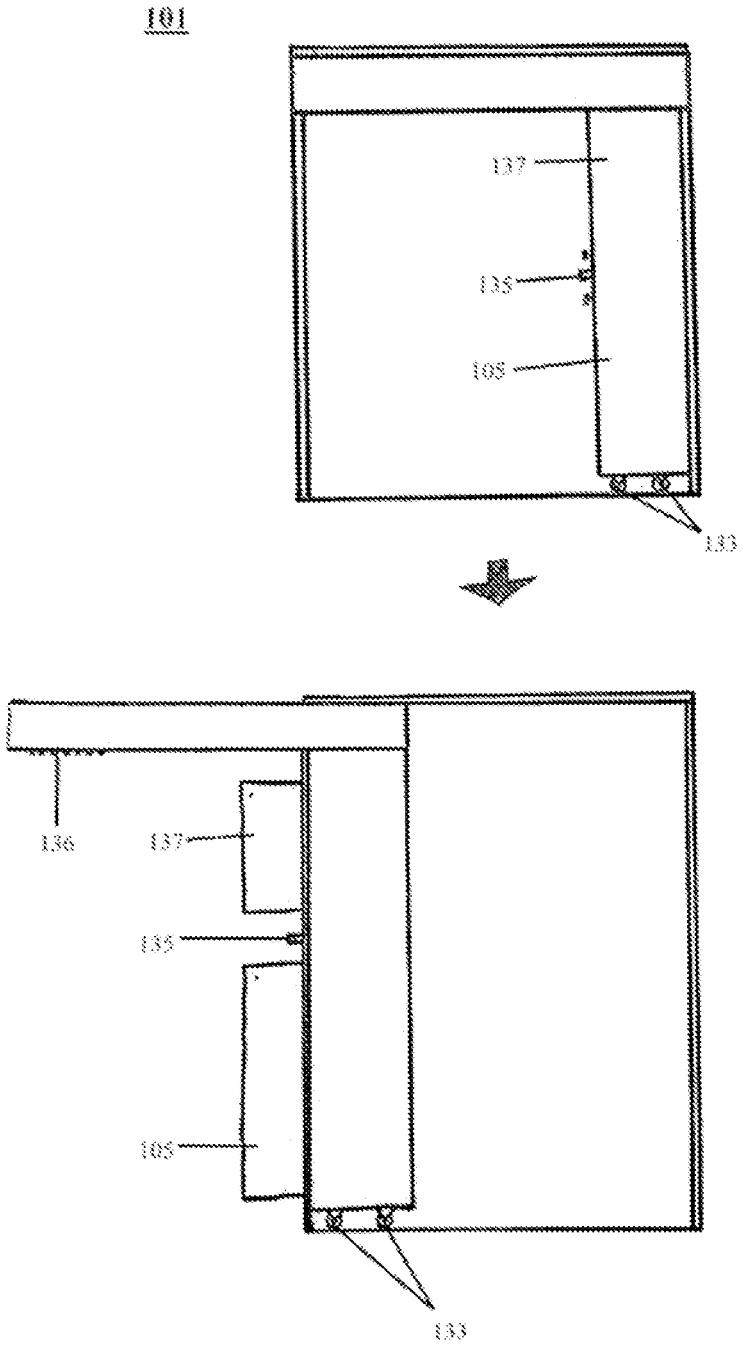
FIG. 4B illustrates a side view of a rest position and a useable position of a shower unit of the housing cabinet of the stackable toilet in accordance with an embodiment of the present subject matter.

FIG. 4B illustrates a side view of a rest position and a useable position of a shower unit of the housing cabinet of the stackable toilet in accordance with an embodiment of the present subject matter. As can be seen in FIG. 4B, the shower unit 101 rests on a wheel base 133 in its rest position having a handle 135 at its centre.

In order to bring the shower in its useable position from the rest position, the shower unit 101 may be dragged by using a handle 135 for its forward movement. As the shower unit is dragged out from the housing cabinet, the topmost housing comprising the concealed shower head is also dragged along the shower unit 101. The shower unit 101 may now be actuated by using the hand shower and mixer for a user to take bath.

Figure 5:
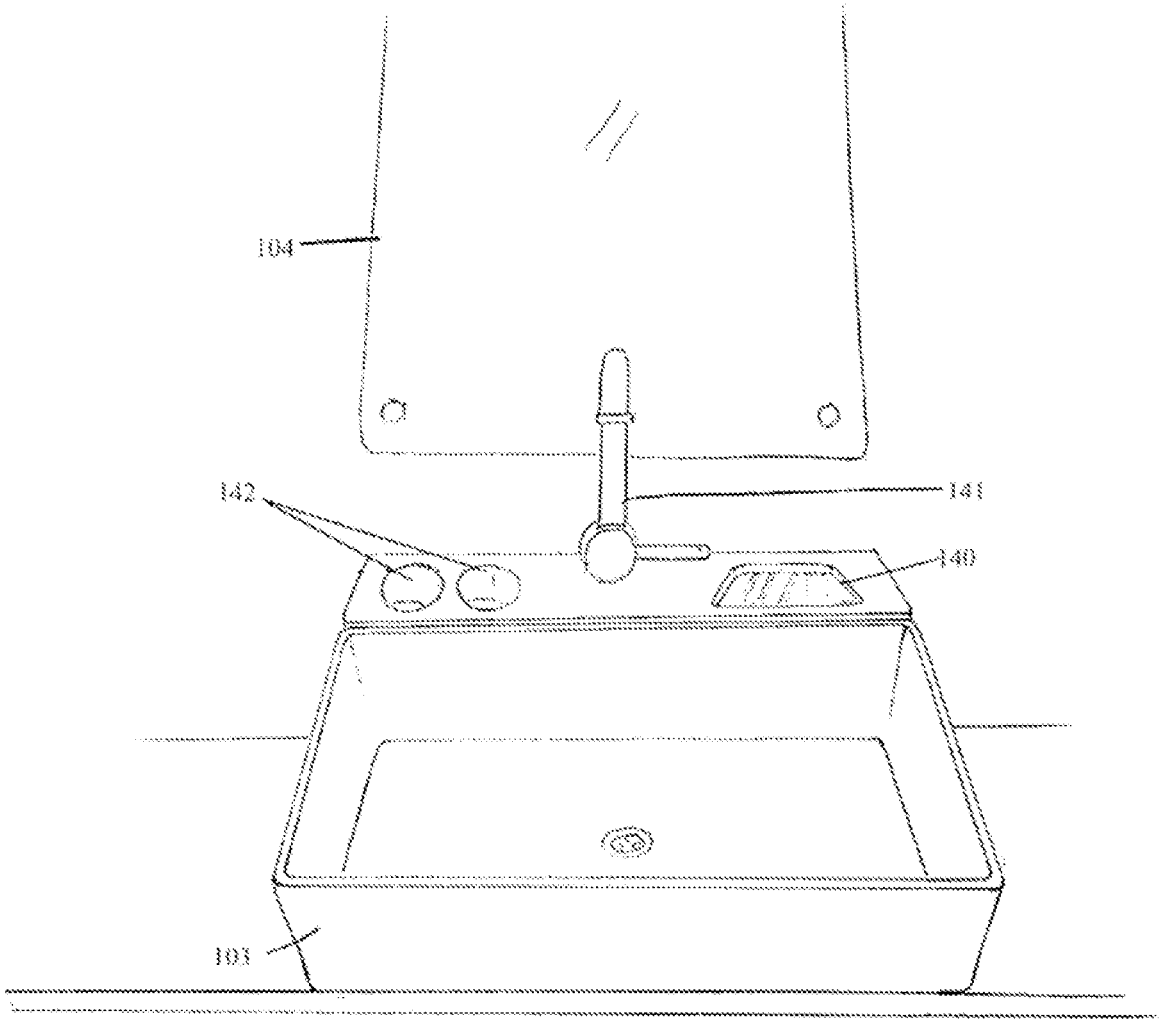
FIG. 5 illustrates a mirror and a wash basin of the housing cabinet of the stackable toilet in accordance with an embodiment of the present subject matter.

FIG. 5 illustrates a mirror 104 and a wash basin 103 of the housing cabinet 100*a* of the stackable toilet 100 in accordance with an embodiment of the present subject matter. The mirror 104 is arranged exactly above the wash basin 103 in the upper portion of the housing cabinet 100*a*. The wash basin 103 may be connected with a main water inlet or a tap inlet 141.

In another embodiment of the present subject matter, the wash basin 103 may comprise one or more stands 142 for toothbrush, a tray 142 for soaps and the like.

Figure 6:
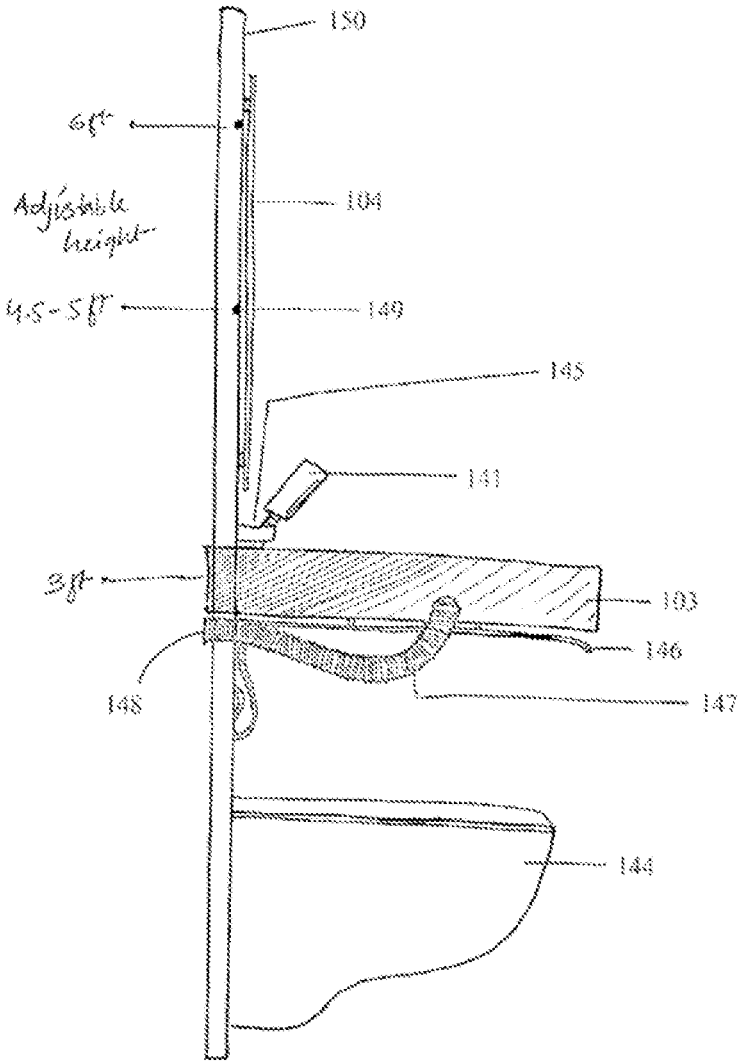
FIG. 6 illustrates a side view of a moveable wash basin or a sink in accordance with another embodiment of the present subject matter.

FIG. 6 illustrates a side view of a moveable wash basin or sink in accordance with another embodiment of the present subject matter. The wall 150 is erected vertically with two vertical side poles 151*a*, 151*b*.

In an alternate embodiment of the present subject matter, the sink 103 may be a moveable sink 103 that may be moved in a vertical direction. The moveable sink 103 is arranged on a spring bar 146 for the movement of the moveable sink 103. The vertical poles 151*a*, 151*b* includes a plurality of locking holes in a vertical direction to lock the moveable sink 103 at different heights. The moveable sink 103 comprises a hand shower 141 as a tap along with an adjustable angle 145 for the tap, and a mixer 152. A drainage pipe 147, connected between the moveable sink 103 and a wall 150, is used to drain out the waste water from the moveable sink 103 to the outlet.

The wall 150, on which the moveable sink 103 is arranged, also comprises the mirror 104 as can been seen in FIG. 6. The vertical poles 151*a*, 151*b* includes the locking holes 149 so as to adjust the height of the moveable sink 103, preferably between 3 feet to 6 feet. The moveable sink 103 is arranged at an optimum height, say 3 feet, on the wall 150 for ease of usage to the user.

Figure 7:
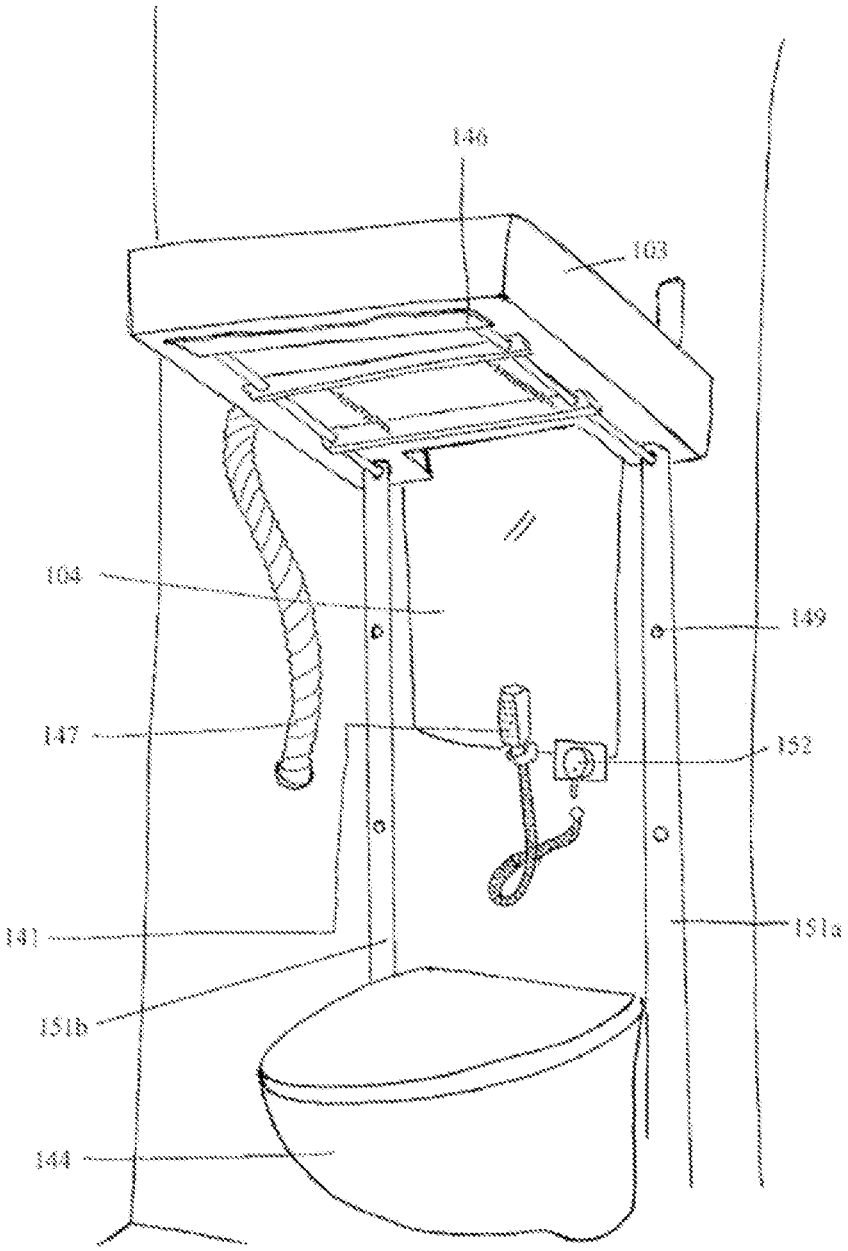
FIG. 7 illustrates a perspective view of a moveable wash basin or a sink in accordance with another embodiment of the present subject matter.

In another embodiment of the present subject matter, as can be seen in FIG. 7, the moveable sink 103 has been arranged and locked at the top of the wall 150 by using spring bar 146.

Figure 8:
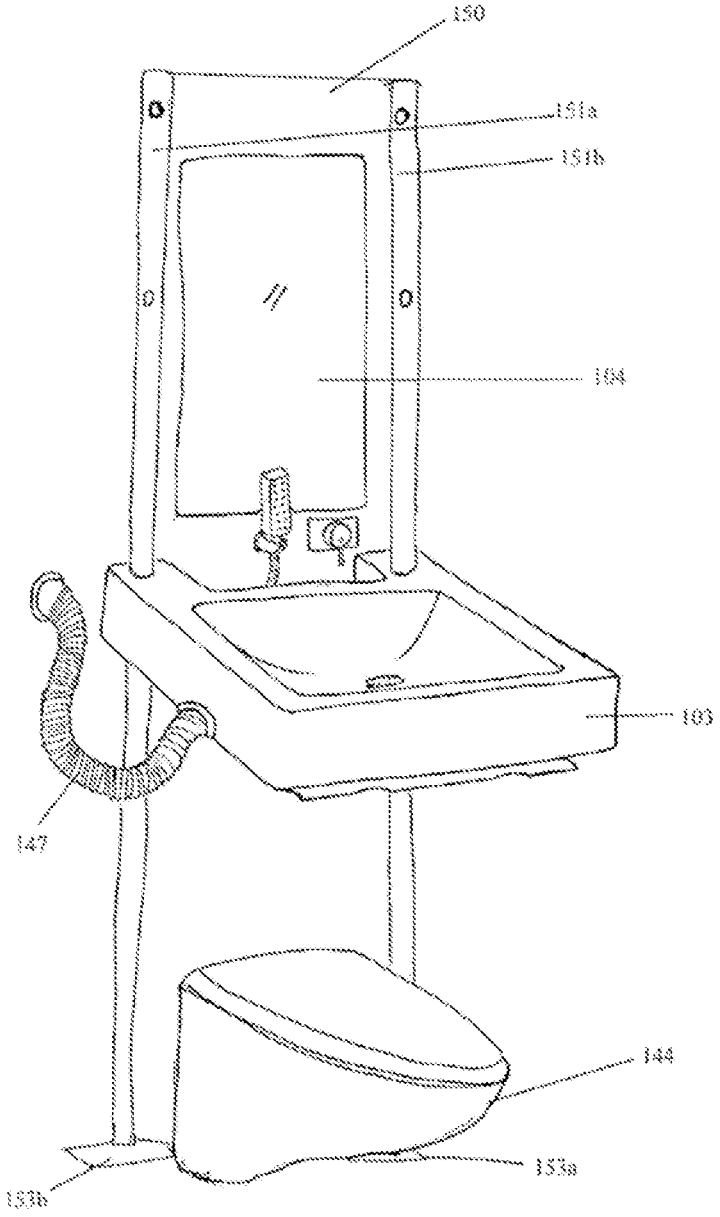
FIG. 8 illustrates a perspective view of a moveable wash basin or a sink in accordance with an embodiment of the present subject matter.

FIG. 8 illustrates a perspective view of a moveable sink in accordance with an embodiment of the present subject matter. As can be seen in FIG. 8, the moveable sink 103 is arranged at an optimum height on the wall 150 and the vertical poles 151*a*, 151*b* for the ease of usage to the user. The vertical poles 151*a*, 151*b* are erected on floor mounting poles 153*a*, 153*b*.

The present subject matter, described herein, relates a stackable toilet cabinet that provides an integrated system of shower unit, commode unit, and wash basin that saves space, saves cost and provides a compact structure. The component of the stackable toilet cabinet are arranged on a wheel base for to and fro movement as and when they are required to be used. The stackable toilet cabinet also comprises a concealed system of pipes and cisterns to enhance the aesthetic appeal of the cabinet.

Although the invention has been described with reference to specific embodiments, this description is not meant to be construed in a limiting sense. Various modifications of the disclosed embodiments, as well as alternate embodiments of the invention, will become apparent to persons skilled in the art upon reference to the description of the invention. It is therefore, contemplated that such modifications can be made without departing from the spirit or scope of the present invention as defined.

We claim:

1. A stackable toilet (100) comprising:

a housing cabinet (100*a*) comprising a shower unit (101), a commode unit (102), and a wash basin (103); the shower unit (101) being arranged in the upper portion of the housing cabinet (100*a*), the shower unit (101) comprising a shower head (136) and a mixer (138) to actuate the shower unit (101), the shower head (136) arranged to be concealed within the housing cabinet (100*a*) when not in use and the shower unit (101) is movable between a rest and useable position; the commode unit (102) arranged in a lower portion of the housing cabinet (100*a*); and the wash basin (103) arranged in the upper portion of the housing cabinet (100*a*) alongside the shower unit (101), the shower unit (101) being installed in the same vertical plane as the commode unit (102), the commode unit (102) comprising a commode (144), the commode (144) being movable between a concealed and an exposed position, the commode (144) being connected with a back plate (128), the back plate (128) being arranged on a wheel base and provided with telescopic rails for installation at an installation site to enable movement of the commode (144) between its concealed and an exposed position.

2. The stackable toilet (100) as claimed in claim 1, wherein the commode (144) is arranged to be concealed within housing cabinet (100*a*) when not in use.

3. The stackable toilet (100) as claimed in claim 2, wherein the commode unit (102) further comprises:

pull doors (126*a*, 126*b*) for concealing the commode (144) when the commode (144) is not in use; and a handle (125) connected to the commode (144);

whereby the handle (125) is used to actuate the commode (144) between its concealed and exposed position.

4. The stackable toilet (100) as claimed in claim 1, wherein the commode (144) is connected with a flush tank (116) by a flush water pipe (132).

5. The stackable toilet (100) as claimed in claim 1, wherein the wash basin (103) is being arranged underneath a mirror (104) in the upper portion of the housing cabinet (100*a*).

6. The stackable toilet (100) as claimed in claim 1, wherein a storage cabinet (105) is arranged underneath the shower unit (101) in the upper portion of the housing cabinet (100*a*).

7. The stackable toilet (100) as claimed in claim 1, wherein a storage cabinet (106) is arranged in the lower portion of the housing cabinet (100*a*).

8. The stackable toilet (100) as claimed in claim 1, wherein the housing cabinet (100*a*) comprises a concealed system of pipes and cisterns to connect the shower unit (101), the commode unit (102), the wash basin (103) and the flush tank (116).

9. The stackable toilet (100) as claimed in claim 1, wherein a power socket (143) is arranged in between the mirror (104) and the wash basin (103) in the upper portion of the housing cabinet (100*a*).

10. The stackable toilet (100) as claimed in claim 1, wherein the wash basin (103), arranged on a wall (150) and vertical poles (151*a*, 151*b*), is moveable along a vertical direction, and wherein the wash basin sink (103) is arranged on a spring bar (146) for its vertical movement.

11. The stackable toilet (100) as claimed in claim 10, wherein the wash basin (103) is moveable and locked at different heights by locking the spring bar (146) at different locking holes (149), the locking holes are arranged on the vertical poles (151*a*, 151*b*).

12. The stackable toilet (100) as claimed in claim 3, whereby the pull doors (126*a*, 126*b*) are actuated to open by the movement of the commode (144) from its concealed to exposed position.

13. The stackable toilet (100) as claimed in claim 1, wherein the commode (144) is connected to a retractable soil pipe (130) that accommodates the movement of the commode (144) between its concealed and exposed position.

14. The stackable toilet (100) as claimed in claim 13, wherein a moving end of the retractable soil pipe (130) is connected to the commode and the other end is fixed to a wall or the floor.

15. The stackable toilet (100) as claimed in claim 1, whereby the back plate (128) is adapted to support the weight of the commode (144).

* * * * *